US010294075B2

(12) United States Patent
Hughes et al.

(10) Patent No.: US 10,294,075 B2
(45) Date of Patent: May 21, 2019

(54) RE-DISPATCHING UNOCCUPIED ELEVATOR CAR FOR OCCUPANT EVACUATION OPERATION

(71) Applicant: Otis Elevator Company, Farmington, CT (US)

(72) Inventors: David M. Hughes, East Hampton, CT (US); James M. Collins, Burlington, CT (US); Jannah A. Stanley, Portland, CT (US); Paul A. Stranieri, Bristol, CT (US); Ronnie E. Thebeau, Haddam, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/281,163

(22) Filed: Sep. 30, 2016

(65) Prior Publication Data

US 2018/0093856 A1 Apr. 5, 2018

(51) Int. Cl.
*B66B 5/02* (2006.01)
*B66B 1/28* (2006.01)

(52) U.S. Cl.
CPC ..... *B66B 5/021* (2013.01); *B66B 1/28* (2013.01)

(58) Field of Classification Search
USPC ..... 187/247
See application file for complete search history.

(56) References Cited

U.S. PATENT DOCUMENTS 6,000,505 A * 12/1999 Allen ..... B66B 5/024 187/247
6,590,496 B2 7/2003 Peterson et al.
6,786,305 B2 9/2004 Kamimura et al.
7,182,174 B2 2/2007 Parrini et al.
7,210,564 B2 5/2007 Kawai
7,366,674 B2 4/2008 Dione
7,377,365 B2 5/2008 Sigeru et al.
7,461,723 B2 12/2008 Kawai
7,588,126 B2 * 9/2009 Siikonen ..... B66B 5/022 187/313
7,594,564 B2 9/2009 Siikonen et al.
7,621,378 B2 11/2009 Kawai
7,669,695 B2 3/2010 Hikita et al.
(Continued)

FOREIGN PATENT DOCUMENTS

EP 1068142 A1 1/2001
EP 1930279 A1 6/2008
(Continued)

OTHER PUBLICATIONS

Extended European Search Report for Application No. 17192560.5; Report dated Mar. 2, 2018; Report Received Date: Mar. 8, 2018; 1-10 pages.

*Primary Examiner* — Christopher Uhlir
(74) *Attorney, Agent, or Firm* — Cantor Colburn LLP

(57) ABSTRACT

A method of operating an elevator system including: receiving an evacuation call from a first evacuation floor; moving an elevator car to the first evacuation floor; opening doors of the elevator car when the elevator car arrives at the first evacuation floor; monitoring, using a sensor system, a remaining capacity of the elevator car; and closing the doors of the elevator car when at least one of a first selected period of time has passed and the remaining capacity is equal to a selected remaining capacity.

20 Claims, 4 Drawing Sheets

(56) References Cited

U.S. PATENT DOCUMENTS

| | | | | |
|---|---|---|---|---|
| 7,677,363 | B2 | 3/2010 | Kawai | |
| 7,688,212 | B2 | 3/2010 | Farley | |
| 7,849,973 | B2 | 12/2010 | Hikita et al. | |
| 7,938,232 | B2 | 5/2011 | Hikita et al. | |
| 7,954,603 | B2 | 6/2011 | Hikita et al. | |
| 8,109,368 | B2 | 2/2012 | Manabe | |
| 8,245,819 | B2 | 8/2012 | Hikita et al. | |
| 8,281,901 | B2 | 10/2012 | Kawai | |
| 8,387,756 | B2 * | 3/2013 | Laihanen | B66B 1/2458 187/387 |
| 8,584,811 | B2 * | 11/2013 | Kuoppala | B66B 1/468 187/316 |
| 8,763,761 | B2 | 7/2014 | Siikonen | |
| 8,839,914 | B2 * | 9/2014 | Iwata | B66B 5/024 187/384 |
| 9,109,896 | B2 | 8/2015 | Banaszuk et al. | |
| 9,120,642 | B2 | 9/2015 | Fujihata | |
| 2004/0163325 | A1 | 8/2004 | Parrini et al. | |
| 2011/0272221 | A1 | 11/2011 | Iwata et al. | |
| 2016/0083219 | A1 | 3/2016 | Sorsa et al. | |
| 2017/0320705 | A1 * | 11/2017 | Honda | B66B 5/021 |

FOREIGN PATENT DOCUMENTS

| | | |
|---|---|---|
| EP | 2531432 | 12/2018 |
| JP | 2007161417 A | 6/2007 |

* cited by examiner

RE-DISPATCHING UNOCCUPIED ELEVATOR CAR FOR OCCUPANT EVACUATION OPERATION

BACKGROUND

The subject matter disclosed herein relates generally to the field of elevator systems, and specifically to a method and apparatus for operating an elevator system in an evacuation.

Commonly, during an evacuation procedure occupants of a building are instructed to take the stairs and avoid the elevator systems. An efficient method of incorporating the elevators into overall evacuation procedures is desired.

BRIEF SUMMARY

According to one embodiment, a method of operating an elevator system is provided. The method includes: receiving an evacuation call from a first evacuation floor; moving an elevator car to the first evacuation floor; opening doors of the elevator car when the elevator car arrives at the first evacuation floor; monitoring, using a sensor system, a remaining capacity of the elevator car; and closing the doors of the elevator car when at least one of a first selected period of time has passed and the remaining capacity is equal to a selected remaining capacity.

In addition to one or more of the features described above, or as an alternative, further embodiments of the method may include moving the elevator car to a discharge floor when the remaining capacity is equal to the selected remaining capacity, wherein the selected remaining capacity is equal to about zero.

In addition to one or more of the features described above, or as an alternative, further embodiments of the method may include: receiving an evacuation call from a second evacuation floor; and moving the elevator car to the second evacuation floor when the first selected period of time has passed and the remaining capacity is greater than zero.

In addition to one or more of the features described above, or as an alternative, further embodiments of the method may include: receiving an elevator call from padding floor; and moving the elevator car to a padding floor when the first selected period of time has passed, the remaining capacity is greater than zero, and there is not a second evacuation floor, or the first selected period of time has passed and the remaining capacity is greater than zero; wherein the padding floor is within a selected number of floors away from the first evacuation floor.

In addition to one or more of the features described above, or as an alternative, further embodiments of the method may include: opening doors of the elevator car when the elevator car arrives at the padding floor; monitoring, using a sensor system, the remaining capacity of the elevator car; closing the doors of the elevator car when at least one of a second selected period of time has passed and the remaining capacity is equal to the selected remaining capacity; receiving an evacuation call from a second evacuation floor after the elevator car arrives at the padding floor; and moving the elevator car to the second evacuation floor when the second selected period of time has passed and the remaining capacity is greater than zero.

In addition to one or more of the features described above, or as an alternative, further embodiments of the method may include: opening doors of the elevator car when the elevator car arrives at the second evacuation floor; monitoring, using a sensor system, the remaining capacity of the elevator car; closing the doors of the elevator car when at least one of a third selected period of time has passed and the remaining capacity is equal to the selected remaining capacity; receiving an elevator call from a padding floor; and moving the elevator car to a padding floor when the third selected period of time has passed and the remaining capacity is greater than zero.

In addition to one or more of the features described above, or as an alternative, further embodiments of the method may include: opening doors of the elevator car when the elevator car arrives at the padding floor; monitoring, using a sensor system, the remaining capacity of the elevator car; closing the doors of the elevator car when the remaining capacity is equal to the selected remaining capacity or about zero; and moving the elevator car to a discharge floor when the remaining capacity is equal to the selected remaining capacity or about zero.

In addition to one or more of the features described above, or as an alternative, further embodiments of the method may include: opening doors of the elevator car when the elevator car arrives at the second evacuation floor; monitoring, using a sensor system, the remaining capacity of the elevator car; closing the doors of the elevator car when the remaining capacity is equal to the selected remaining capacity or about zero; and moving the elevator car to a discharge floor when the remaining capacity is equal to the selected remaining capacity or about zero.

According to another embodiment, a controller of an elevator system is provided. The controller including: a processor; a memory including computer-executable instructions that, when executed by the processor, cause the processor to perform operations. The operations include: receiving an evacuation call from a first evacuation floor; moving an elevator car to the first evacuation floor; opening doors of the elevator car when the elevator car arrives at the first evacuation floor; monitoring a remaining capacity of the elevator car; and closing the doors of the elevator car when at least one of a first selected period of time has passed and the remaining capacity is equal to a selected remaining capacity.

In addition to one or more of the features described above, or as an alternative, further embodiments of the controller may include that the operations further include: moving the elevator car to a discharge floor when the remaining capacity is equal to the selected remaining capacity, wherein the selected remaining capacity is equal to about zero.

In addition to one or more of the features described above, or as an alternative, further embodiments of the controller may include that the operations further include: receiving an evacuation call from a second evacuation floor; and moving the elevator car to the second evacuation floor when the first selected period of time has passed and the remaining capacity is greater than zero.

In addition to one or more of the features described above, or as an alternative, further embodiments of the controller may include that the operations further include: receiving an elevator call from padding floor; and moving the elevator car to a padding floor when the first selected period of time has passed, the remaining capacity is greater than zero, and there is not a second evacuation floor, or the first selected period of time has passed and the remaining capacity is greater than zero; wherein the padding floor is within a selected number of floors away from the first evacuation floor.

In addition to one or more of the features described above, or as an alternative, further embodiments of the controller may include that the operations further include: opening doors of the elevator car when the elevator car arrives at the padding floor; monitoring, using a sensor system, the remaining capacity of the elevator car; closing the doors of the elevator car when at least one of a second selected period of time has passed and the remaining capacity is equal to the selected remaining capacity; receiving an evacuation call from a second evacuation floor after the elevator car arrives at the padding floor; and moving the elevator car to the second evacuation floor when the second selected period of time has passed and the remaining capacity is greater than zero.

In addition to one or more of the features described above, or as an alternative, further embodiments of the controller may include that the operations further include: opening doors of the elevator car when the elevator car arrives at the second evacuation floor; monitoring, using a sensor system, the remaining capacity of the elevator car; closing the doors of the elevator car when at least one of a third selected period of time has passed and the remaining capacity is equal to the selected remaining capacity; receiving an elevator call from a padding floor; and moving the elevator car to a padding floor when the third selected period of time has passed and the remaining capacity is greater than zero.

In addition to one or more of the features described above, or as an alternative, further embodiments of the controller may include that the operations further include: opening doors of the elevator car when the elevator car arrives at the padding floor; monitoring, using a sensor system, the remaining capacity of the elevator car; closing the doors of the elevator car when the remaining capacity is equal to the selected remaining capacity or about zero; and moving the elevator car to a discharge floor when the remaining capacity is equal to the selected remaining capacity or about zero.

In addition to one or more of the features described above, or as an alternative, further embodiments of the controller may include that the operations further include: opening doors of the elevator car when the elevator car arrives at the second evacuation floor; monitoring, using a sensor system, the remaining capacity of the elevator car; closing the doors of the elevator car when the remaining capacity is equal to the selected remaining capacity or about zero; and moving the elevator car to a discharge floor when the remaining capacity is equal to the selected remaining capacity or about zero.

According to another embodiment, a computer program product tangibly embodied on a computer readable medium is provided. The computer program product including instructions that, when executed by a processor, cause the processor to perform operations. The operations include: receiving an evacuation call from a first evacuation floor; moving an elevator car to the first evacuation floor; opening doors of the elevator car when the elevator car arrives at the first evacuation floor; monitoring, using a sensor system, a remaining capacity of the elevator car; and closing the doors of the elevator car when at least one of a first selected period of time has passed and the remaining capacity is equal to a selected remaining capacity.

In addition to one or more of the features described above, or as an alternative, further embodiments of the computer program may include that the operations further include: moving the elevator car to a discharge floor when the remaining capacity is equal to the selected remaining capacity, wherein the selected remaining capacity is equal to about zero.

In addition to one or more of the features described above, or as an alternative, further embodiments of the computer program may include that the operations further include: receiving an evacuation call from a second evacuation floor; and moving the elevator car to the second evacuation floor when the first selected period of time has passed and the remaining capacity is greater than zero.

In addition to one or more of the features described above, or as an alternative, further embodiments of the computer program may include that the operations further include: receiving an elevator call from padding floor; and moving the elevator car to a padding floor when the first selected period of time has passed, the remaining capacity is greater than zero, and there is not a second evacuation floor, or the first selected period of time has passed and the remaining capacity is greater than zero; wherein the padding floor is within a selected number of floors away from the first evacuation floor.

Technical effects of embodiments of the present disclosure include a control system to control the operation of an elevator by sending the elevator to a first evacuation floor when an evacuation procedure is initiated and reallocating the elevator car to a second evacuation floor or a padding floor if the elevator has remaining capacity.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the disclosure are apparent from the following detailed description taken in conjunction with the accompanying drawings in which like elements are numbered alike in the several FIGURES.

DETAILED DESCRIPTION

Figure 1:
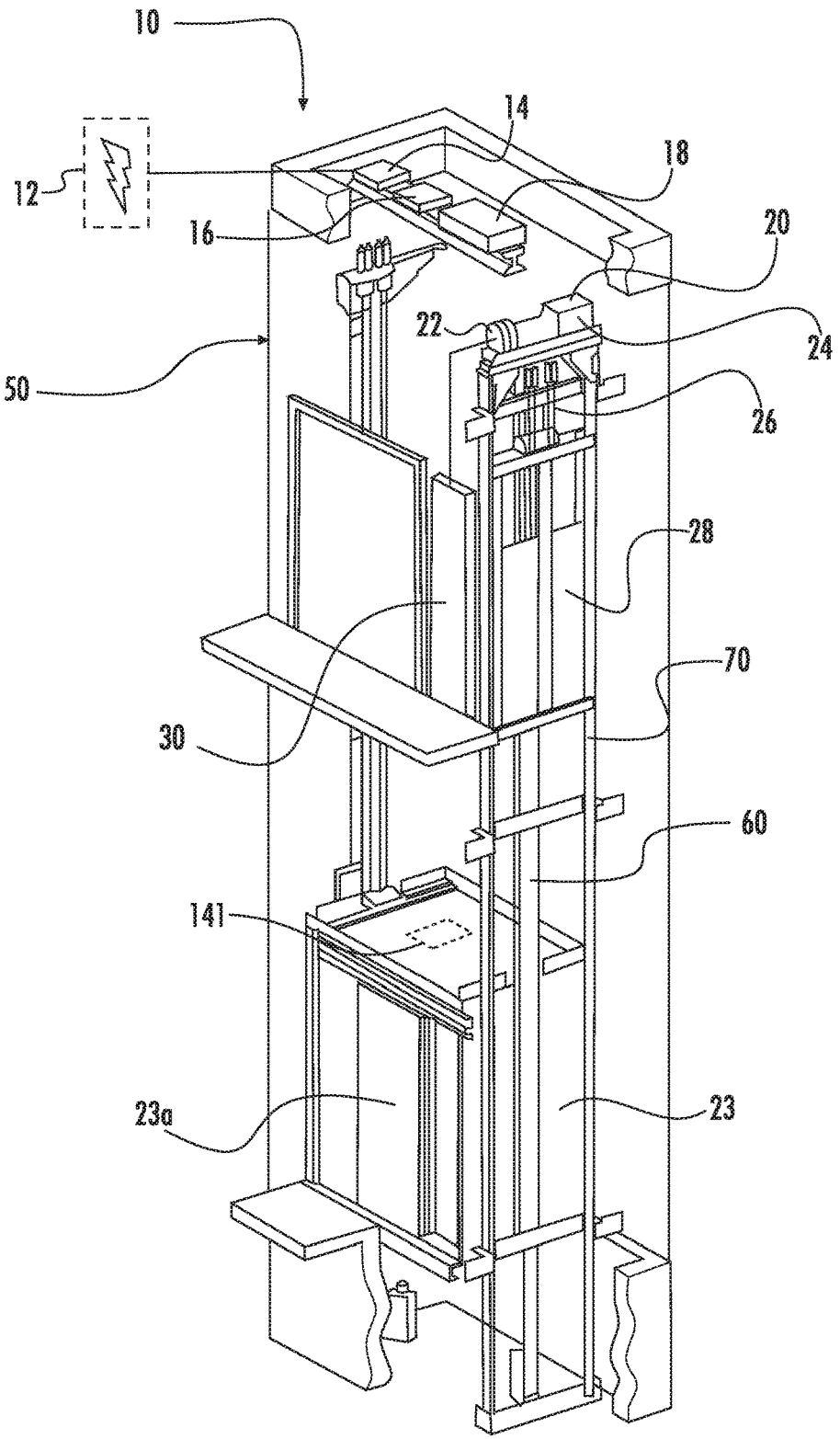
FIG. 1 illustrates a schematic view of an example elevator system, in accordance with an embodiment of the disclosure.
Figure 2:
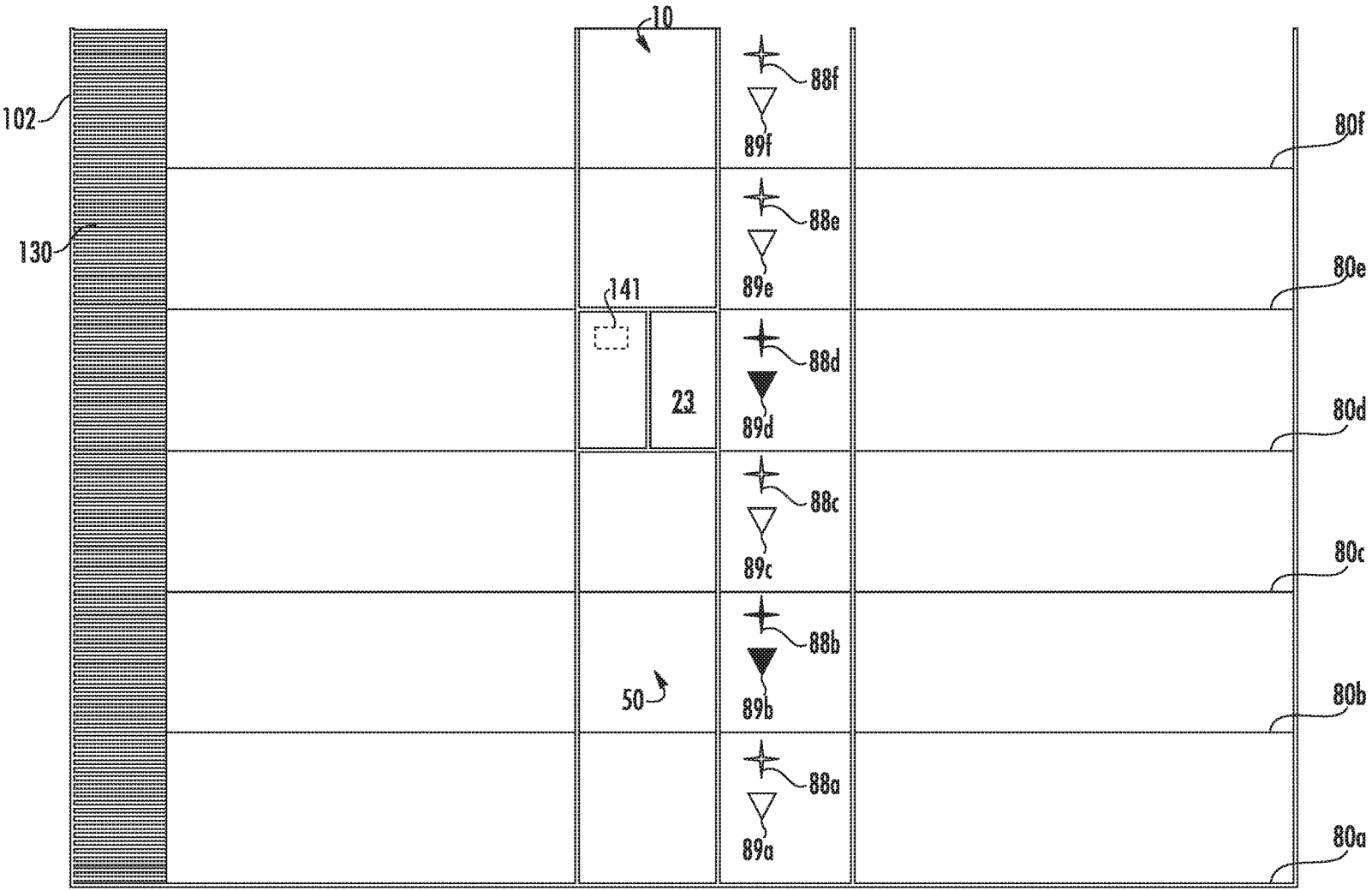
FIG. 2 illustrates a schematic view of a building incorporating the example elevator system of FIG. 1, in accordance with an embodiment of the disclosure.

FIG. 1 shows a schematic view of an example elevator system 10, in accordance with an embodiment of the disclosure. FIG. 2 shows schematic view of a building 102 incorporating the example elevator system 10 of FIG. 1, in accordance with an embodiment of the disclosure. With reference to FIG. 1, the elevator system 10 includes an elevator car 23 configured to move vertically upward and downward within a hoistway 50 along a plurality of car guide rails 60. The elevator system 10 also includes a counterweight 28 operably connected to the elevator car 23 via a pulley system 26. The counterweight 28 is configured to move vertically upward and downward within the hoistway 50. The counterweight 28 moves in a direction generally opposite the movement of the elevator car 23, as is known in conventional elevator assemblies. Movement of the counterweight 28 is guided by counterweight guide rails 70 mounted within the hoistway 50. The elevator car 23 also has doors 23*a* to open and close, allowing passengers to enter and exit the elevator car 23.

The elevator system 10 also includes a power source 12. The power is provided from the power source 12 to a switch panel 14, which may include circuit breakers, meters, etc. From the switch panel 14, the power may be provided directly to the drive unit 20 through the controller 30 or to an internal power source charger 16, which converts AC power to direct current (DC) power to charge an internal power source 18 that requires charging. For instance, an internal power source 18 that requires charging may be a battery, capacitor, or any other type of power storage device known to one of ordinary skill in the art. Alternatively, the internal power source 18 may not require charging from the external power source 12 and may be a device such as, for example a gas powered generator, solar cells, hydroelectric generator, wind turbine generator or similar power generation device. The internal power source 18 may power various components of the elevator system 10 when an external power source is unavailable. The drive unit 20 drives a machine 22 to impart motion to the elevator car 23 via a traction sheave of the machine 22. The machine 22 also includes a brake 24 that can be activated to stop the machine 22 and elevator car 23. As will be appreciated by those of skill in the art, FIG. 1 depicts a machine room-less elevator system 10, however the embodiments disclosed herein may be incorporated with other elevator systems that are not machine room-less or that include any other known elevator configuration. In addition, elevator system may have more than one independently operating elevator car in each elevator shaft and/or ropeless elevator systems may also be used. In addition, the elevator car may include two or more compartments. In an embodiment, the elevator car may include two or more compartments.

The controller 30 is responsible for controlling the operation of the elevator system 10. The controller 30 may also determine a mode (motoring, regenerative, near balance) of the elevator car 23. The controller 30 may use the car direction and the weight distribution between the elevator car 23 and the counterweight 28 to determine the mode of the elevator car 23. The controller 30 may adjust the velocity of the elevator car 23 to reach a target floor. The controller 30 may include a processor and an associated memory. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

The elevator system 10 may also include a sensor system 141 configured to detect a remaining capacity in a particular elevator car 23. The remaining capacity allows the controller 30 to determine how much space is left in the elevator car 23. For instance, if the remaining capacity is equal to about zero there is no space left in the elevator car 23 to accept more passengers, whereas if the remaining capacity is greater than zero there may be space to accept more passengers in the elevator car 23. The sensor system 141 is in operative communication with the controller 30. The sensor system 141 may use a variety of sensing mechanisms such as, for example, a visual detection device, a weight detection device, a laser detection device, a door reversal monitoring device, a thermal image detection device, and a depth detection device. The visual detection device may be a camera that utilizes visual recognition to identify individual passengers and objects in the elevator car 23 and then determine remaining capacity. The weight detection device may be a scale to sense the amount of weight in an elevator car 23 and then determine the remaining capacity from the weight sensed. The laser detection device may detect how many passengers walk through a laser beam to determine the remaining capacity in the elevator car 23. Similarly, a door reversal monitoring device also detects passengers entering the car so as not to close the elevator door on a passenger and thus may be used to determine the remaining capacity. The thermal detection device may be an infrared or other heat sensing camera that utilizes detected temperature to identify individual passengers and objects in the elevator car 23 and then determine remaining capacity. The depth detection device may be a 2-D, 3-D or other depth/distance detecting camera that utilizes detected distance to an object and/or passenger to determine remaining capacity. As may be appreciated by one of skill in the art, in addition to the stated methods, additional methods may exist to sense remaining capacity and one or any combination of these methods may be used to determine remaining capacity in the elevator car 23.

Advantageously, determining the remaining capacity of the elevator car 23 may determine whether to send the elevator car 23 to another floor 80*a*-80*f* or the discharge floor(FIG. 2). A discharge floor may be a floor 80*a*-80*f* where occupants (i.e.: passengers) can evacuate the building 102 (FIG. 2). For example, in one embodiment the discharge floor may be a ground floor. In the example of FIG. 2, the discharge floor may be floor 80*a*.

FIG. 2 shows a building 102 incorporating an elevator system 10. The building 102 includes multiple floors 80*a*-80*f*, each floor 80*a*-80*f* having an elevator call button 89*a*-89*f* and an evacuation alarm 88*a*-88*f*. The elevator call button 89*a*-89*f* sends an elevator call to the controller 30. The elevator call button 89*a*-89*f* may be a push button and/or a touch screen and may be activated manually or automatically. For example, the elevator call button 89*a*-89*f* may be activated by a building occupant pushing the elevator call button 89*a*-89*f*. The elevator call button 89*a*-89*f* may also be activated voice recognition or a passenger detection mechanism in the hallway, such as, for example a weight sensing device, a visual recognition device, and a laser detection device. The evacuation alarm 88*a*-88*f* may be activated or deactivated either manually or automatically through a fire alarm system. If the evacuation alarm 88*a*-88*f* is activated, an evacuation call is sent to the controller 30 indicating the respective floor 80*a*-80*f* where the evacuation alarm 88*a*-88*f* was activated. In the example of FIG. 2, an evacuation alarm 88*d* is activated first on floor 88*d* and then a second evacuation alarm 88*b* is later activated on floor 80*b*. The evacuation alarm 88*a*, 88*c*, 88*e*, 88*f* is not activated on floors 80*a*, 80*c*, 80*e*, and 80*f*. The first floor to activate an evacuation alarm 88*a*-88*f* may be known as the first evacuation floor. In the example of FIG. 2, the first evacuation floor is floor 80*d*. The second evacuation floor to activate an evacuation alarm may be known as the second evacuation floor and so on.

The first evacuation floor may be surrounded by padding floors, which are floors that are considered at increased risk due to their proximity to the evacuation floor and thus should also be evacuated. In the example of FIG. 2, the padding floors for the first evacuation floor are floors 80*b*, 80*c*, 80*e*, and 80*f*. The padding floors may include floors that are a selected number of floors away from the first evacuation floor. In one embodiment, the padding floors may include any number of floors on either side of an evacuation floor. For example, in one embodiment, the padding floors may include the floor immediately below the evacuation floor and the three floors immediately above the evacuation floor. In another example, in one embodiment, the padding floors may include the two floors above the first evacuation floor and the two floors below the first evacuation floor. The first evacuation floor and the padding floors make up an evacuation zone. In the example of FIG. 2, the evacuation zone is composed of floors 80*b*-80*f*.

In one embodiment, there may be more than one evacuation floor. For example, after the first evacuation floor activates an evacuation alarm, a second evacuation floor may also activate an evacuation alarm. In the example of FIG. 2, the second evacuation floor is floor 80*b*. In one embodiment, there may be any number of evacuation floors. Evacuation floors may be evacuated in the order that the evacuation call is received. Padding floors of the first evacuation floor may be evacuated before the second evacuation floor. In one embodiment, all evacuation floors may be evacuated first, followed by padding floors associated with each evacuation floor in the order in which the corresponding evacuation call was placed. Although in the embodiment of FIG. 2 the second evacuation floor is contiguous to the padding floors of the first evacuation floor, the second evacuation floor and any subsequent evacuation floors may be located anywhere within the building. The building also includes a discharge floor, which is a floor where occupants can evacuate the building 102. For example, in one embodiment the discharge floor may be a ground floor. In one embodiment, the discharge floor may be any floor that permits an occupant to evacuate the building. In the example of FIG. 2, the discharge floor is floor 80*a*. The building may also include a stairwell 130 as seen in FIG. 2.

Figure 3:
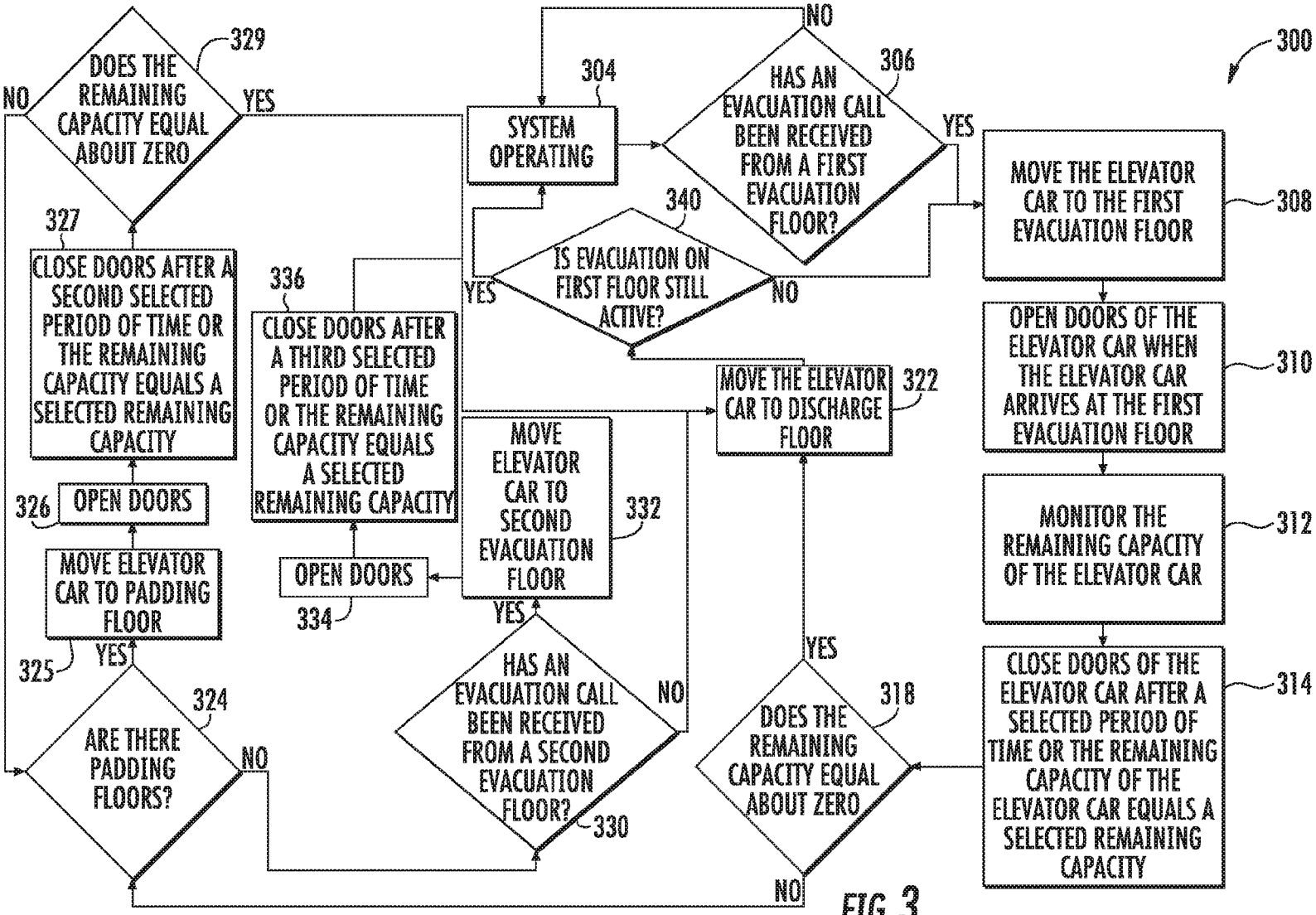
FIG. 3 is a flow chart of method of operating the example elevator system of FIG. 1, in accordance with an embodiment of the disclosure.

Referring now to FIG. 3, while referencing components of FIGS. 1 and 2. FIG. 3 shows a flow chart of method 300 of operating the example elevator system 10 of FIG. 1, in accordance with an embodiment of the disclosure. At block 304, the elevator system 10 is under normal operation. At block 306, the controller 30 is checking whether it has received an evacuation call from a first evacuation floor. At block 306, if the controller 30 has received an evacuation call from a first evacuation floor then the controller 30 moves an elevator car 23 to the first evacuation floor at block 308. At block 310, the controller 30 opens the doors 23*a* of the elevator car 23 when the elevator car 23 arrives at the first evacuation floor. At block 312, the sensor system 141 monitors the remaining capacity of the elevator car 23. At block 314, the controller 30 will close the elevator doors 23*a* after a selected period of time has passed or the remaining capacity of the elevator car equals a selected remaining capacity. The selected period of time may be enough time to allow passengers to fill the remaining capacity of the elevator car 23, such as, for example ten seconds. The selected period of time may change in response to many factors including the remaining capacity and thus there may be a second selected period of time, a third selected period of time, and so on to account for the variations the time required to load passengers at each floor. The selected remaining capacity may be a maximum capacity of the elevator car 23 (ex: the maximum capacity is when the remaining capacity is equal to about zero) or the selected remaining capacity may be the remaining capacity of the elevator car 23 after a known number of passengers on the floor have entered the elevator car 23.

At block 314, if the selected period of time has passed or the remaining capacity of the elevator car 23 equals a selected remaining capacity then the method 300 will move to block 318 to check whether the remaining capacity is equal to about zero. For example, if the remaining capacity equals about zero then there is no room for any more passengers. At block 318, if the remaining capacity is greater than zero then the controller 30 will check if there are any padding floors at block 324. A padding floor exists if an elevator call has been received from the padding floor indicating that there are still passengers left on the padding floor. At block 318, if the remaining capacity is equal to about zero then the controller 30 moves the elevator car 23 to the discharge floor at block 322.

At block 324, if there are padding floors, then the controller 30 moves the elevator car 23 to a padding floor at block 325, opens the doors 23*a* allowing passengers to enter at block 326 and then closes the doors 23*a* after a second selected period of time or the remaining capacity equals a selected remaining capacity at block 327. Then the controller checks whether the remaining capacity is equal to about zero at block 329. At block 329, if the remaining capacity equals about zero then the controller 30 moves the elevator car to the discharge floor at block 322 to allow the passengers to evacuate the building 102. At block 329, if there is remaining capacity in the elevator car 23 then the method returns to block 324 to check for more padding floors. At block 324, if there are no padding floors, then the controller 30 checks whether an evacuation call has been received from a second evacuation floor at block 330. At block 330, if an evacuation call has been received from a second evacuation floor then the controller 30 moves the elevator car 23 to the second evacuation floor at block 332, opens the doors 23*a* allowing passengers to enter at block 334, closes the doors 23*a* after a third selected period of time or the remaining capacity equals a selected remaining capacity at block 336, and moves the elevator car 23 to the discharge floor at block 332. At block 330, if an evacuation call has not been received from a second evacuation floor then the controller 30 moves the elevator car 23 to the discharge floor at block 322. Once the controller 30 has moved the elevator car 23 to the discharge floor at block 322 and passengers have exited the elevator car 23 at the discharge floor, the controller 30 will check to see whether the evacuation is still active on the first evacuation floor at block 340. At block 340, if the evacuation is not still active on the first evacuation floor then the method will return to block 304. At block 340, if the evacuation is still active on the first evacuation floor then the method will return to block 308.

While the above description has described the flow process of FIG. 3 in a particular order, it should be appreciated that unless otherwise specifically required in the attached claims that the ordering of the steps may be varied.

Figure 4:
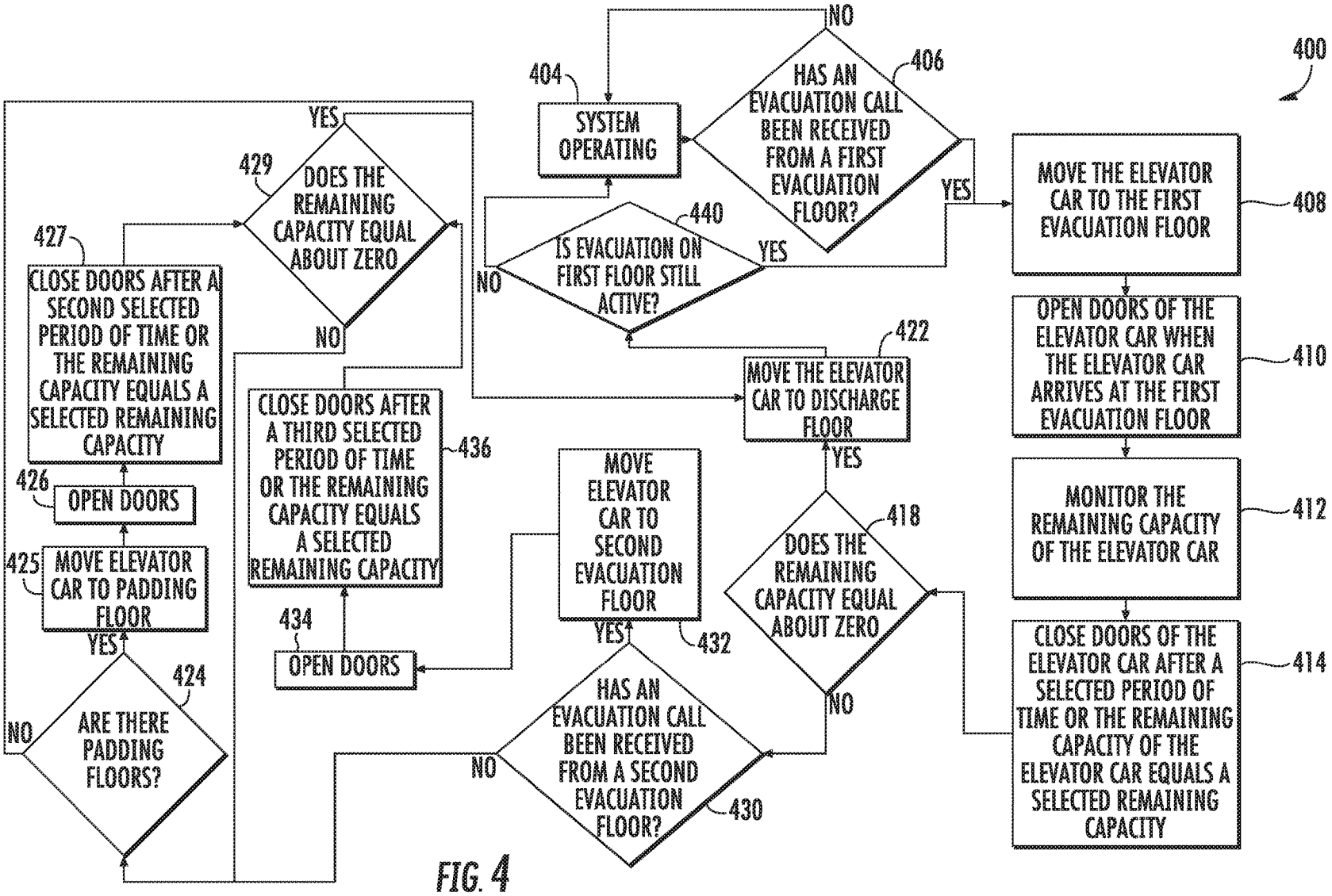
FIG. 4 is a flow chart of method of operating the elevator system of FIG. 1, in accordance with an embodiment of the disclosure.

Referring now to FIG. 4, while referencing components of FIGS. 1 and 2. FIG. 4 shows a flow chart of method 400 of operating the elevator system 10 of FIG. 1, in accordance with an embodiment of the disclosure. At block 404, the elevator system 10 is under normal operation. At block 406, the controller 30 is checking whether it has received an evacuation call from a first evacuation floor. At block 406, if the controller 30 has received an evacuation call from a first evacuation floor then the controller 30 moves an elevator car 23 to the first evacuation floor at block 408. At block 410, the controller 30 opens the doors 23*a* of the elevator car 23 when the elevator car 23 arrives at the first evacuation floor. At block 412, the sensor system 141 monitors the remaining capacity of the elevator car 23. At block 414, the controller 30 will close the elevator doors 23*a* after a selected period of time has passed or the remaining capacity of the elevator car equals a selected remaining capacity. The selected period of time may be enough time to allow passengers to fill the remaining capacity of the elevator car 23, such as, for example ten seconds. The selected period of time may change in response to many factors including the remaining capacity and thus there may be a second selected period of time, a third selected period of time, and so on to account for the variations the time required to load passengers at each floor. The selected remaining capacity may be a maximum capacity of the elevator car 23 (ex: the maximum capacity is when the remaining capacity is equal to about zero) or the selected remaining capacity may be the remaining capacity of the elevator car 23 after a known number of passengers on the floor have entered the elevator car 23.

At block 414, if the selected period of time has passed or the remaining capacity of the elevator car 23 equals a selected remaining capacity then the method 400 will move to block 418 to check whether the remaining capacity is equal to about zero. For example, if the remaining capacity equals about zero then there is no room for any more passengers. At block 418, if the remaining capacity is greater than zero then the controller 30 will check if there is a second evacuation floor at block 430. At block 418, if the remaining capacity is equal to about zero then the controller 30 moves the elevator car 23 to the discharge floor at block 422.

At block 430, if an evacuation call has been received from a second evacuation floor then the controller 30 moves the elevator car 23 to the second evacuation floor at block 432, opens the doors 23*a* allowing passengers to enter at block 434, closes the doors 23*a* after a second selected period of time or the remaining capacity equals a selected remaining capacity at block 436, and then checks if the remaining capacity is equal to about zero at block 429. At block 429, if remaining capacity does equals zero then the controller 30 moves the elevator car to the discharge floor at block 422. At block 429, if remaining capacity does equals zero then the controller 30 checks if there are any padding floors at block 424. A padding floor exists if an elevator call has been received from the padding floor indicating that there are still passengers left on the padding floor.

At block 424, if there are padding floors, then the controller 30 moves the elevator car 23 to a padding floor at block 425, opens the doors 23*a* allowing passengers to enter at block 426 and then closes the doors 23*a* after a second selected period of time or the remaining capacity equals a selected remaining capacity at block 427. Then the controller checks whether the remaining capacity is equal to about zero at block 429. At block 429, if the remaining capacity equals about zero then the controller 30 moves the elevator car to the discharge floor at block 422 to allow the passengers to evacuate the building 102. At block 429, if there is remaining capacity in the elevator car 23 then the method returns to block 424 to check for more padding floors. At block 424, if there are no padding floors, then the controller 30 moves the elevator car 23 to the discharge floor at block 422. Once the controller 30 has moved the elevator car 23 to the discharge floor at block 422 and passengers have exited the elevator car 23 at the discharge floor, the controller 30 will check to see whether the evacuation is still active on the first evacuation floor at block 448. At block 440, if the evacuation is not still active on the first evacuation floor then the method will return to block 404. At block 440, if the evacuation is still active on the first evacuation floor then the method will return to block 408.

While the above description has described the flow process of FIG. 4 in a particular order, it should be appreciated that unless otherwise specifically required in the attached claims that the ordering of the steps may be varied.

As described above, embodiments can be in the form of processor-implemented processes and devices for practicing those processes, such as processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting. While the description has been presented for purposes of illustration and description, it is not intended to be exhaustive or limited to embodiments in the form disclosed. Many modifications, variations, alterations, substitutions or equivalent arrangement not hereto described will be apparent to those of ordinary skill in the art without departing from the scope of the disclosure. Additionally, while the various embodiments have been described, it is to be understood that aspects may include only some of the described embodiments. Accordingly, the disclosure is not to be seen as limited by the foregoing description, but is only limited by the scope of the appended claims.

What is claimed is:

1. A method of operating an elevator system, the method comprising:

receiving an evacuation call from a first evacuation floor;

moving an elevator car to the first evacuation floor;

opening doors of the elevator car when the elevator car arrives at the first evacuation floor;

monitoring, using a sensor system, a remaining capacity of the elevator car; and closing the doors of the elevator car when at least one of a first selected period of time has passed and the remaining capacity is equal to a selected remaining capacity, wherein the first selected period of time is determined at least in part in response to the remaining capacity of the elevator car;

receiving an elevator call from at least one of a second evacuation floor and a padding floor within a selected number of floors away from the first evacuation floor; and moving the elevator car to at least one of the second evacuation floor and the padding floor when the first selected period of time has passed and the remaining capacity is greater than zero.

2. The method of claim 1, further comprising:

moving the elevator car to a discharge floor when a remaining capacity monitored after arrival at the at least one of the second evacuation floor and the padding floor is equal to about zero.

3. The method of claim 1, wherein:

the elevator car is moved to the padding floor when a call has not been received from the second evacuation floor, the first selected period of time has passed, and the remaining capacity is greater than zero.

4. The method of claim 1, further comprising:

opening doors of the elevator car when the elevator car arrives at the padding floor;

monitoring, using a sensor system, the remaining capacity of the elevator car;

closing the doors of the elevator car when at least one of a second selected period of time has passed and the remaining capacity is greater than zero, wherein the second selected period of time is determined in response to the remaining capacity of the elevator car;

receiving an evacuation call from a second evacuation floor after the elevator car arrives at the padding floor; and moving the elevator car to the second evacuation floor when the second selected period of time has passed and the remaining capacity is greater than zero.

5. The method of claim 1, further comprising:

opening doors of the elevator car when the elevator car arrives at the second evacuation floor;

monitoring, using a sensor system, the remaining capacity of the elevator car;

closing the doors of the elevator car when at least one of an additional selected period of time has passed and the remaining capacity is greater than zero, wherein the additional selected period of time is determined in response to the remaining capacity of the elevator car;

receiving an elevator call from a padding floor; and moving the elevator car to a padding floor when the additional selected period of time has passed and the remaining capacity is greater than zero.

6. The method of claim 5, further comprising:

opening doors of the elevator car when the elevator car arrives at the padding floor;

monitoring, using a sensor system, the remaining capacity of the elevator car;

closing the doors of the elevator car when the remaining capacity is equal to the selected remaining capacity or about zero; and moving the elevator car to a discharge floor when the remaining capacity is equal to the selected remaining capacity or about zero.

7. The method of claim 4, further comprising:

opening doors of the elevator car when the elevator car arrives at the second evacuation floor;

monitoring, using a sensor system, the remaining capacity of the elevator car;

closing the doors of the elevator car when the remaining capacity is equal to the selected remaining capacity or about zero; and moving the elevator car to a discharge floor when the remaining capacity is equal to the selected remaining capacity or about zero.

8. A controller of an elevator system comprising:

a processor;

a memory comprising computer-executable instructions that, when executed by the processor, cause the processor to perform operations, the operations comprising:

receiving an evacuation call from a first evacuation floor;

moving an elevator car to the first evacuation floor;

opening doors of the elevator car when the elevator car arrives at the first evacuation floor;

monitoring a remaining capacity of the elevator car;

closing the doors of the elevator car when at least one of a first selected period of time has passed and the remaining capacity is equal to a selected remaining capacity, wherein the first selected period of time is determined at least in part in response to the remaining capacity of the elevator car;

receiving an elevator call from at least one of a second evacuation floor and a padding floor within a selected number of floors away from the first evacuation floor; and moving the elevator car to at least one of the second evacuation floor and the padding floor when the first selected period of time has passed and the remaining capacity is greater than zero.

9. The controller of claim 8, wherein the operations further comprise:

moving the elevator car to a discharge floor when a remaining capacity monition after arrival at the at least one of the second evacuation floor and the padding floor is equal to about zero.

10. The controller of claim 8, wherein:

the elevator car is moved to the padding floor when a call has not been received from the second evacuation floor, the first selected period of time has passed, and the remaining capacity is greater than zero.

11. The controller of claim 10, wherein the operations further comprise:

opening doors of the elevator car when the elevator car arrives at the padding floor;

monitoring, using a sensor system, the remaining capacity of the elevator car;

closing the doors of the elevator car when at least one of a second selected period of time has passed and the remaining capacity is greater than zero, wherein the second selected period of time is determined in response to the remaining capacity of the elevator car;

receiving an evacuation call from a second evacuation floor after the elevator car arrives at the padding floor; and moving the elevator car to the second evacuation floor when the second selected period of time has passed and the remaining capacity is greater than zero.

12. The controller of claim 8, wherein the operations further comprise:

opening doors of the elevator car when the elevator car arrives at the second evacuation floor;

monitoring, using a sensor system, the remaining capacity of the elevator car;

closing the doors of the elevator car when at least one of an additional selected period of time has passed and the remaining capacity is greater than zero, wherein the additional selected period of time is determined in response to the remaining capacity of the elevator car;

receiving an elevator call from a padding floor; and moving the elevator car to a padding floor when the additional selected period of time has passed and the remaining capacity is greater than zero.

13. The controller of claim 12, wherein the operations further comprise:

opening doors of the elevator car when the elevator car arrives at the padding floor;

monitoring, using a sensor system, the remaining capacity of the elevator car;

closing the doors of the elevator car when the remaining capacity is equal to the selected remaining capacity or about zero; and moving the elevator car to a discharge floor when the remaining capacity is equal to the selected remaining capacity or about zero.

14. The controller of claim 11, wherein the operations further comprise:

opening doors of the elevator car when the elevator car arrives at the second evacuation floor;

monitoring, using a sensor system, the remaining capacity of the elevator car;

closing the doors of the elevator car when the remaining capacity is equal to the selected remaining capacity or about zero; and moving the elevator car to a discharge floor when the remaining capacity is equal to the selected remaining capacity or about zero.

15. A computer program product embodied on a computer readable medium, the computer program product including instructions that, when executed by a processor, cause the processor to perform operations comprising:

receiving an evacuation call from a first evacuation floor;

moving an elevator car to the first evacuation floor;

opening doors of the elevator car when the elevator car arrives at the first evacuation floor;

monitoring, using a sensor system, a remaining capacity of the elevator car;

closing the doors of the elevator car when at least one of a first selected period of time has passed and the remaining capacity is equal to a selected remaining capacity, wherein the first selected period of time is determined at least in part in response to the remaining capacity of the elevator car;

receiving an elevator call from at least one of a second evacuation floor and a padding floor within a selected number of floors away from the first evacuation floor; and moving the elevator car to at least one of the second evacuation floor and the padding floor when the first selected period of time has passed and the remaining capacity is greater than zero.

16. The computer program product of claim 15, wherein the operations further comprise:

moving the elevator car to a discharge floor when a remaining capacity monitored after arrival at the at least one of the second evacuation floor and the padding floor is equal to about zero.

17. The computer program product of claim 15, wherein:

the elevator car is moved to the padding floor when a call has not been received from the second evacuation floor, the first selected period of time has passed, and the remaining capacity is greater than zero.

18. The method of claim 1, wherein:

the sensor system is a door reversal device.

19. The controller of claim 8, wherein:

the remaining capacity of the elevator car is monitored using a door reversal device.

20. The computer program product of claim 15, wherein:

the sensor system is a door reversal device.

* * * * *